US010731947B2

(12) United States Patent
Grace et al.

(10) Patent No.: US 10,731,947 B2
(45) Date of Patent: Aug. 4, 2020

(54) OPEN FRAME SIGHT SYSTEM

(71) Applicant: Grace Engineering Corp., Memphis, MI (US)

(72) Inventors: Louis Grace, North Street, MI (US); Cody M. Schulz, Harrison Township, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 16/385,160

(22) Filed: Apr. 16, 2019

(65) Prior Publication Data

US 2019/0360777 A1 Nov. 28, 2019

Related U.S. Application Data

(60) Provisional application No. 62/675,246, filed on May 23, 2018.

(51) Int. Cl.
*F41G 1/14* (2006.01)
*F41G 1/34* (2006.01)
*F41G 1/06* (2006.01)

(52) U.S. Cl.
CPC ..... *F41G 1/345* (2013.01); *F41G 1/065* (2013.01); *F41G 1/14* (2013.01)

(58) Field of Classification Search
CPC ..... F41G 1/14; F41G 1/16; F41G 1/26; F41G 1/28; F41G 1/30; F41G 1/345
USPC ..... 42/113, 130, 131, 140, 148
See application file for complete search history.

(56) References Cited

U.S. PATENT DOCUMENTS

| | | | | |
|---|---|---|---|---|
| 2,394,521 | A * | 2/1946 | Lynn | F41G 1/30 356/252 |
| 3,439,970 | A * | 4/1969 | Rickert | F41G 1/14 42/131 |
| 5,483,362 | A | 1/1996 | Tai et al. | |
| 8,082,688 | B2 | 12/2011 | Elpedes et al. | |
| 8,443,541 | B2 | 5/2013 | Elpedes et al. | |
| 2018/0196628 | A1 * | 7/2018 | Samo | F41G 3/08 |

* cited by examiner

*Primary Examiner* — Stephen Johnson
(74) *Attorney, Agent, or Firm* — Warner Norcross + Judd LLP

(57) ABSTRACT

An aiming device is provided including a body, an illumination device associated with the body and an optical element, where the illumination device is operable to selectively display a dot on the optical element being visible to a user. The optical element can include an upper edge and a lower edge, and the dot can display closer to the upper edge than to the lower edge, in some cases in the upper half or one third of the height of the optical element. The device can include a protective frame to which the optical element is joined, and the optical element upper edge can be unconcealed by any part of the protective frame above the upper edge, falling within an open top span of the frame. The optical element can be removable and replaceable relative to the protective frame, with a retainer plate temporarily securing the element to the frame.

19 Claims, 7 Drawing Sheets

OPEN FRAME SIGHT SYSTEM

CROSS-REFERENCE TO RELATED APPLICATION

This application claims benefit of U.S. Provisional Application (62/675,246), filed May 23, 2018 which is hereby incorporated by reference in its entirety.

BACKGROUND OF THE INVENTION

The present invention relates to aiming devices, and more particularly to reflex aiming devices having an increased field of view.

The popularity and use of firearms for hunting, target shooting, and other dynamic shooting sports, has increased over the past several decades. The fast-paced, competitive nature of shooting and the desire by hunters to have well placed, ethical shots, have led to the development and commercialization of a variety of aiming devices. These devices include fiber optic sights, illuminated scope reticles and reflex sights, to name a few.

Reflex sights typically are used with firearms in a variety of shooting sports and hunting activities where quick target acquisition is favorable. Such sights superimpose a bright illuminated dot against the center of a lens or window that is fully encased by a protective frame. The firearm is aimed by placing the superimposed dot on a target as viewed through the window. Due to the centering of the dot in the window, and in particular, at a central focal point on the window, the window and superimposed dot are both usually centered on the target.

Reflex sights have recently become more popular on handguns. Handguns are smaller than long guns, such as rifles, and thus smaller sights are favored. With most present technology, however, the profile of most reflex sights remains rather tall. This is because the superimposed dot typically is generated by a small light emitting diode disposed at the focal point the lens, which is selectively reflective to the wavelength of the illumination. The focal point of most reflex sight lenses is usually located at the geometric center of the lens. Thus, the lens has to sit rather high above the body of the reflex sight to ensure the dot remains in the full field of view of the user. With the lens being so tall, the profile of the sight also is increased. This can increase the possibility of the sight snagging on a holster, clothing or other elements in a shooting competition or during a hunting activity, when time to acquire a target in the sight may be limited.

In addition, most lenses of the above noted reflex sights are constructed from glass, which can be prone to being scratched. Glass lenses also can be cracked or fractured if the firearm is dropped or inadvertently engaged with objects at the range or in the field. Thus, the above reflex sights are circumferentiated with a protective frame to protect all the edges of the lens, and especially the top edge of the lens which sits highest on the sight, which means it is usually most prone to being bumped. The top edge of the lens is covered and concealed by a top frame guard, which is enlarged to cast a shadow on the lens so that the superimposed dot is viewable when ambient light is intense. The top frame guard also can include an upper rubber bumper guard to soften impact if the sight engages another object or the firearm is dropped. With the top frame guard being enlarged, and/or the upper rubber bumper being present, however, these components of the protective frame obscure a notable portion of a target when aiming the sight. This can in some cases make target acquisition more difficult and time consuming.

Accordingly, there remains room for improvement in the field of aiming devices, particularly with regard to reflex sights to enhance target acquisition and further minimize the profile of such devices.

SUMMARY OF THE INVENTION

An aiming device is provided in the form of an open top reflex sight, having no protective frame disposed over an upper edge of a lens or window of the sight, so that upper edge generally is exposed, except optionally where it is coated with a special coating and/or protective layer.

In one embodiment, the aiming device or sight includes a body which houses electronics and a frame joined with the body. The frame includes a base and upright arms extending upward from the base on opposing sides of the base, with the arms terminating at free ends. An optical element is mounted relative to the frame between the upright arms, and extends upward from the base.

In a further embodiment, the optical element includes a lower edge adjacent the base, and first and second side edges adjacent the respective opposing arms. The optical element can include an upper edge that is free from attachment to the frame, except optionally portions of the upper edge that begin at the transition of the side edges to that upper edge.

In another embodiment, the optical element can be removable and/or replaceable relative to the frame and sight. The frame can define a recess that is shaped and dimensioned to receive the optical element within it. The sight can include a retainer plate that overlaps part of the optical element. The retainer plate can be secured with fasteners to secure the optical element relative to the frame, in the recess.

In still another embodiment, the removable optical element can include registration apertures and the frame can include registration pins or vice versa, optionally disposed in the recess. When the optical element is placed in the recess or relative to the frame, the registration features can register with one another and position the optical element precisely and consistently in the sight so that an illumination device producing dot is also consistently aligned with the optical element.

In even another embodiment, the sight can include a kit having multiple optical elements suited for different light conditions within which the sight can be utilized. For example, a first optical element can include a first optical coating designed for viewing a displayed dot, mark, indicia and/or reticle pattern (all of which are referred to as a "dot" herein) on the optical element in low light conditions (such as dusk or dawn light), a second optical element can include a second optical coating designed for viewing a displayed dot on the optical element in intense, bright light conditions (such as noon light), and a third optical element can include a third optical coating designed for viewing a displayed dot on the optical element in some other light between the foregoing.

In yet another embodiment, the sight can include one or more removable and replaceable cushion elements. These elements can be disposed between a rear surface of the optical element and the recess of the frame, and/or between a front surface of the optical element and the retainer plate.

In a further embodiment, the sight can be configured so that the dot is displayed on the optical element, which can be constructed from glass, a polymer, crystal or other light transmissive materials by electronics housed in the body.

In still a further embodiment, the dot can be displayed on the upper one third of the optical element, rather than in the middle of the optical element.

In yet a further embodiment, the dot can be displayed on the upper quarter of the optical element, rather than in the middle of the optical element.

In even a further embodiment, the dot can be displayed on the optical element, between an uppermost, and optionally free, edge of the optical element, and a lowermost edge of the optical element optionally adjacent the frame. The dot can be displayed closer to the uppermost edge than to the lowermost edge, optionally so that the dot optionally is not midway between those edges, or optionally is not centered between those edges.

In yet a further embodiment, the optical element can have an element height extending between an uppermost edge of the optical element, and a lowermost edge of the optical element. The displayed dot can be superimposed on the optical element at a dot height, which is the distance between the lowermost edge of the optical element and the center of the dot which is to be placed on a target for aiming. The ratio of the dot height to the element height is optionally at least 2:3, further optionally between 2:1 and 1:1, inclusive, yet further optionally between 2:3 and 1:1, inclusive.

The current embodiments of the aiming device provide benefits in shooting sports and hunting that previously have been unachievable. For example, where the sight includes an open top of a protective frame, this construction allows a user to view more of a target as compared to conventional closed protective frames of reflex sights. Further, the present open protective frame enables a user to more quickly visualize and acquire the target because more of the target is viewable in the field of view of the optical element, particularly while centering the superimposed dot on the target. Where the optical element is removable and/or replaceable relative to the frame and sight in general, a user can quickly change out a scratched, chipped or otherwise compromised optical element. In addition, where the sight is provided with multiple different optical elements in a kit, a user can quickly customize their sight and use an optical element best suited for the application. In cases where the dot is displayed in the upper portion of the optical element, closer to the uppermost edge than to the lowermost edge of the optical element, the overall height and profile of the sight can be decreased as compared to conventional reflex sights having a red dot centered on a lens. In other words, such as a sight can eliminate the excess height of the lens common to prior sights having a red dot perfectly centered on a lens, for example, at the focal point of the lens.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A current embodiment of the aiming system, also referred to as a sight herein, is illustrated in FIGS. 1-6 and generally designated 10. To begin, the sight 10 is shown mounted on a semi-automatic pistol. The sight 10 can, however, be mounted on other types of projectile shooting devices. For example, it can be mounted to other types of firearms, including but not limited to a rifle (for example, a long rifle, a carbine, an assault rifle, a bolt pump rifle or a battle rifle); a shotgun (of any gauge) and/or a machine gun (for example, a machine pistol, a light machine gun, a mini gun, a medium machine gun or a heavy machine gun). The firearm can include any type of action, for example, bolt action, lever action, pump action and/or break action. The firearm can be single shot, automatic and/or semiautomatic. Further optionally, the firearm can be in the form of a vehicle-mounted weapon, mounted directly to the vehicle, a watercraft or other mode of transportation of course. As used herein, firearm can also include cannons, howitzers, handheld rocket launchers and similar weaponry, as well as equipment such as paint ball markers and air rifles such as bb guns, air soft guns and/or pellet guns. The projectile shooting device alternatively can be in the form of an archery bow, including but not limited to a compound bow, a recurve bow, a crossbow, or other device from which arrows or bolts can be shot.

Figure 1:
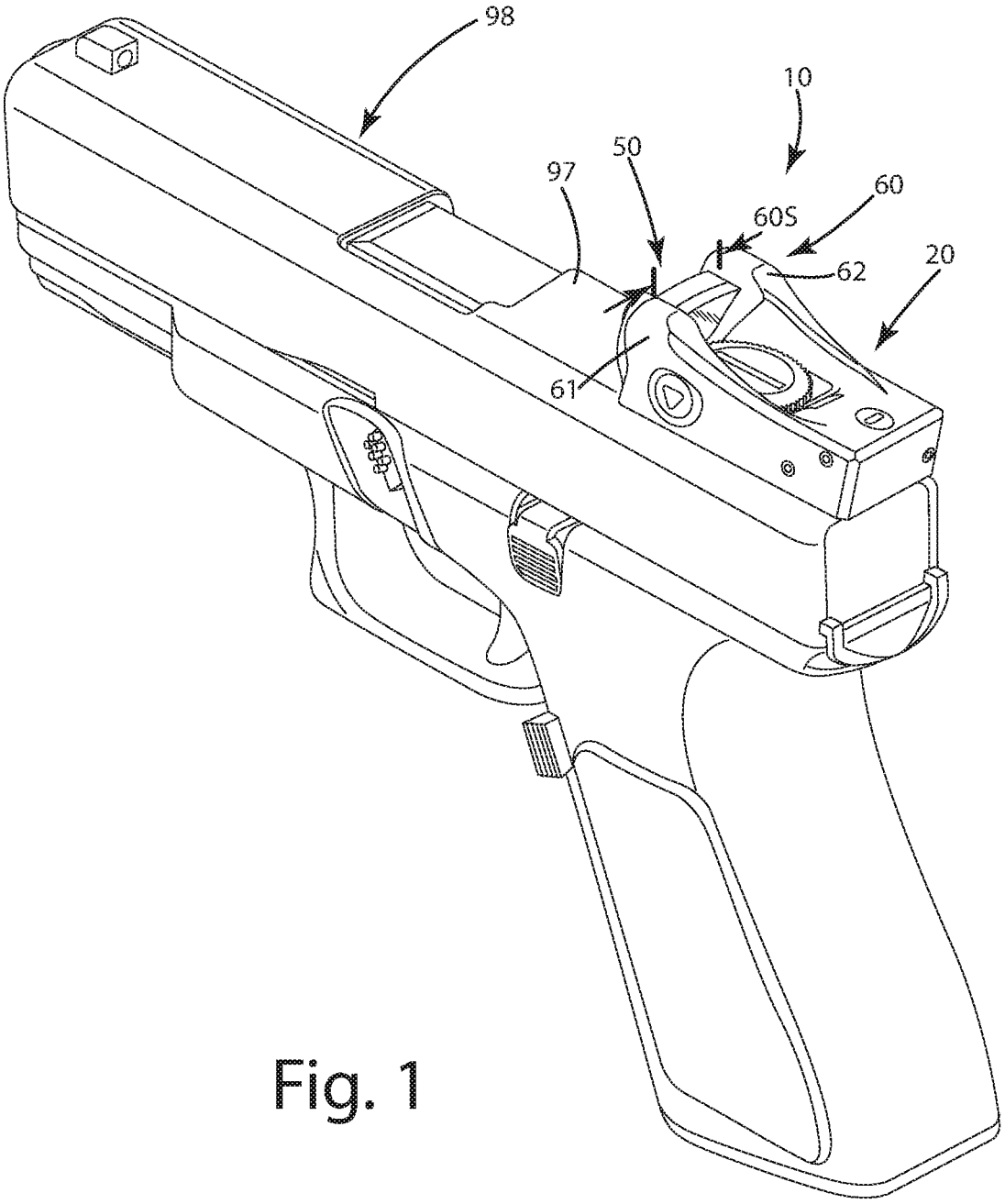
FIG. 1 is a rear perspective view of the aiming device of a current embodiment mounted on a firearm.

Returning to the sight 10 mounted on the firearm in FIG. 1, the sight can be mounted atop a slide 97 of the pistol 98, generally to the rear of the slide, over a grip of the pistol. The sight 10 can be mounted in the same location where a mechanical rear sight was once located.

The sight 10 can include a body 20 that functions as a housing for electronics, an illumination device 30 and a power source 39, such as a battery, capacitor or other electricity storing or generating element. The body 20 includes an upwardly extending open top protective frame 40 joined with the body and optionally forming a portion thereof. An optical element 50, optionally in the form of a non-magnifying lens can be mounted in a generally upright position in the protective frame, thereby providing a viewing window for a target T in a field of view. Light, illumination and/or a holographic image is emitted from an illumination device 30, which in some cases can be in the form of a miniature light emitting diode (LED), positioned at a focal point rearward of optical element 50 and within the body 20.

The illumination device 30 can be operable to selectively display a dot 59 (FIGS. 5, 6) on the optical element that is visible to a user within a field of view of the user. In this regard, the light from the illumination device 30 optionally can be reflected rearward toward the user's eye by a dichroic reflection layer or coating of the optical element, which can be a lens 50 as collimated light, so that the user perceives the reflected light as the dot is superimposed on the field of view at infinite distance. Although shown as a circular shaped dot, the dot 59 can come in variety of shapes, sizes and configurations. As used herein, the term dot can refer to any dot, mark, image indicia and/or reticle pattern used to sight the aiming device on a target. The term dot also can refer to holographic images that are used to sight the aiming device on a target, whether or not disposed or displayed on the optical element, or in front of it or behind it.

The power source 39 can be disposed in a battery compartment 39C defined by the body 20. The power source 39 can be a button cell that powers electronics 38 that drive the illumination device 30. The battery can be accessed via a threaded lid 39L that covers a threaded opening to the compartment located in body 20 between optical element 50 and the illumination device 30. The lid 39L can be recessed below the illumination device 30 to provide a clear optical path for illumination generated by it to reach lens 50. A small slot or notch 39N is provided in a top of lid to assist in grasping it with a user's fingernail for toolless opening, or with the rim of a cartridge, a coin or tool. When closed, the lid 39L can be sealed to body 20 via an O-ring (not shown) that is compressed between lid and a tapered surface bordering the opening to the compartment 39C.

Figure 3:
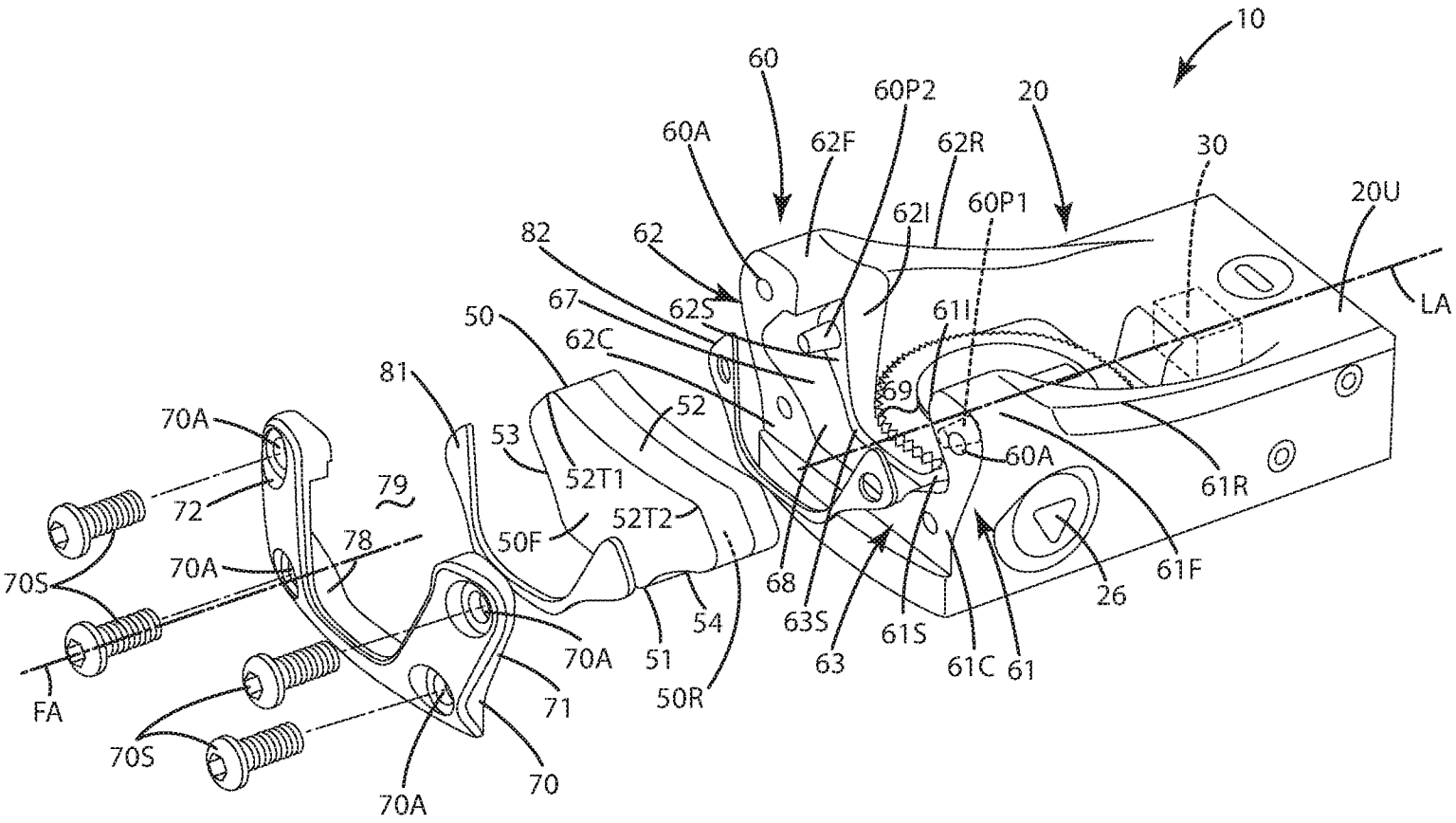
FIG. 3 is a front exploded view of the aiming device illustrating a replaceable optical element.
Figure 4:
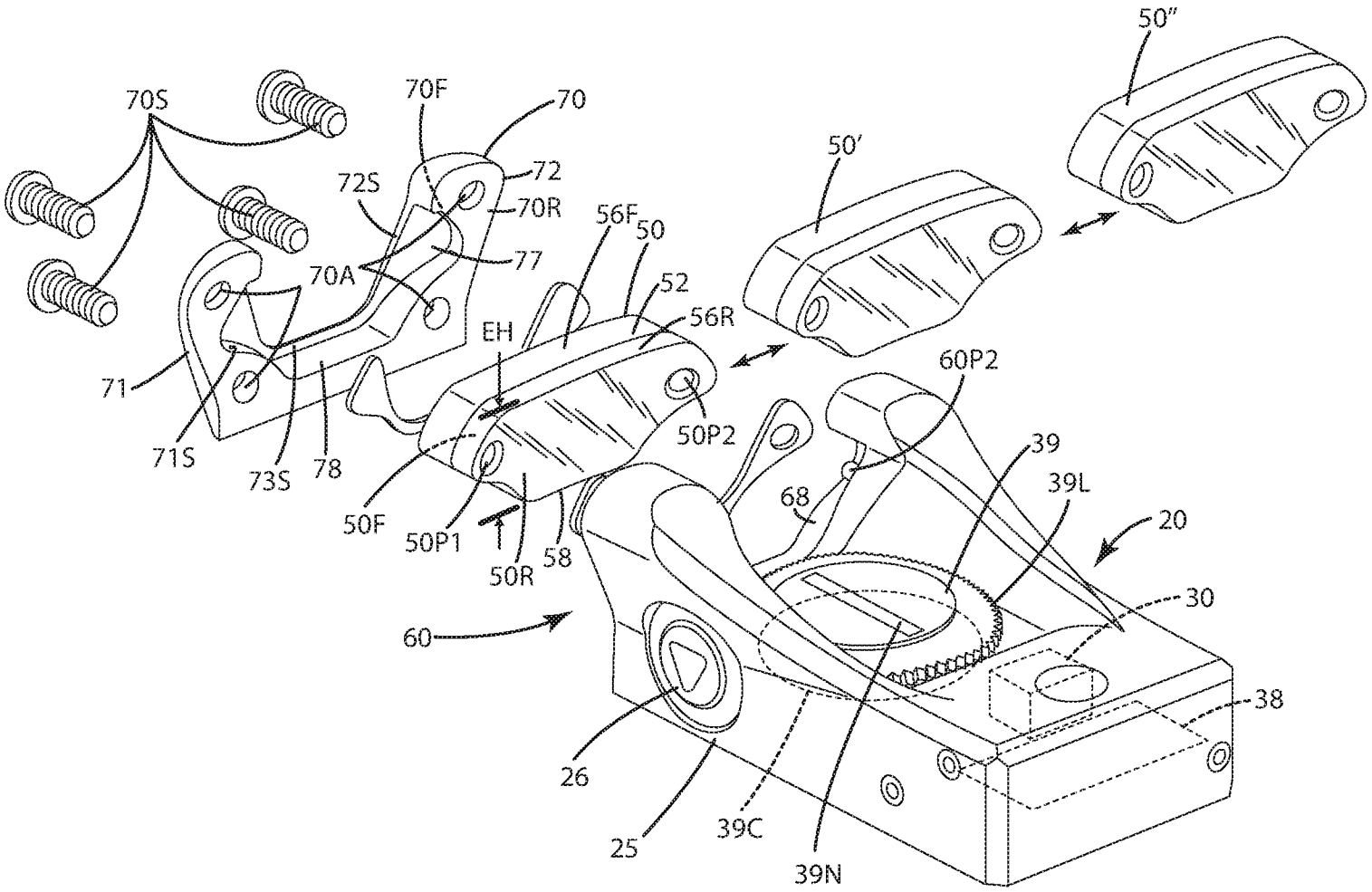
FIG. 4 is a rear exploded view of the aiming device illustrating the replaceable optical element, with other available alternative optical elements.

With reference to FIGS. 3-4, the body 20 can include a set switch 25 including a selector button 26 formed of an elastomeric or flexible plastic material that is manually depressible to actuate switch 25 and thereby control a setting of sight 10. The selector button 26 may allow a user to control of a setting of the sight, such as an illumination mode, illumination brightness, reticle pattern, other attribute of illuminated aiming mark 59, or an ON/OFF function of the sight 10. Generally the selector button can be in electrical communication with the electronics 38 of the sight, which can include a circuit, a processor or other elements that are further in communication with the illumination device 30 and/or the power source 39. Again, the selector switch 25 can provide signal input to the electronics and enables a user to cycle through various illumination settings of sight 10. Optionally, the selector button 26 can be depressed to toggle between an automatic mode and one or more manual modes for an illumination setting of aiming mark 59. In an automatic mode, a photo sensor or other light sensor (not shown) of sight 10 can measure ambient light and a brightness control circuit may automatically determine and set an appropriate illumination intensity of aiming mark 59 based on the measured ambient light. In a manual mode, the user can cycle through various illumination settings by manually depressing selector button until a suitable light intensity level is obtained. Further optionally, a user can depress the selector button to cycle through several settings in sequence, including: ON, high, medium or low intensity, and OFF.

With reference to FIGS. 1-6, the sight includes the optical element 50 noted above. This optical element 50 can be joined with the body 20 via a protective frame 60, which can form part of the body. The protective frame 60 can be integrally formed with the body or a housing of the body. In many cases, the protective frame can be aesthetically integrated into and can form an extension of the body and its components. The frame itself and/or the body can be constructed from a variety of materials, such as polymers, composites, metals and combinations thereof.

As shown in FIGS. 3-4 the protective frame 60 can include a base 63, a first upright arm 61 and a second upright arm 62. The base, first arm and second arm can cooperatively form a viewing recess 69 within which the optical element 50 is at least partially disposed. The base 63 can extend laterally from a left side to a right side of the sight 10, generally crossing the longitudinal axis LA. The base 63 can include a support shoulder 63S that forms a portion of a support recess 67. The base can be configured to engage or be placed adjacent a lower edge 51 of the optical element 50.

Figure 6:
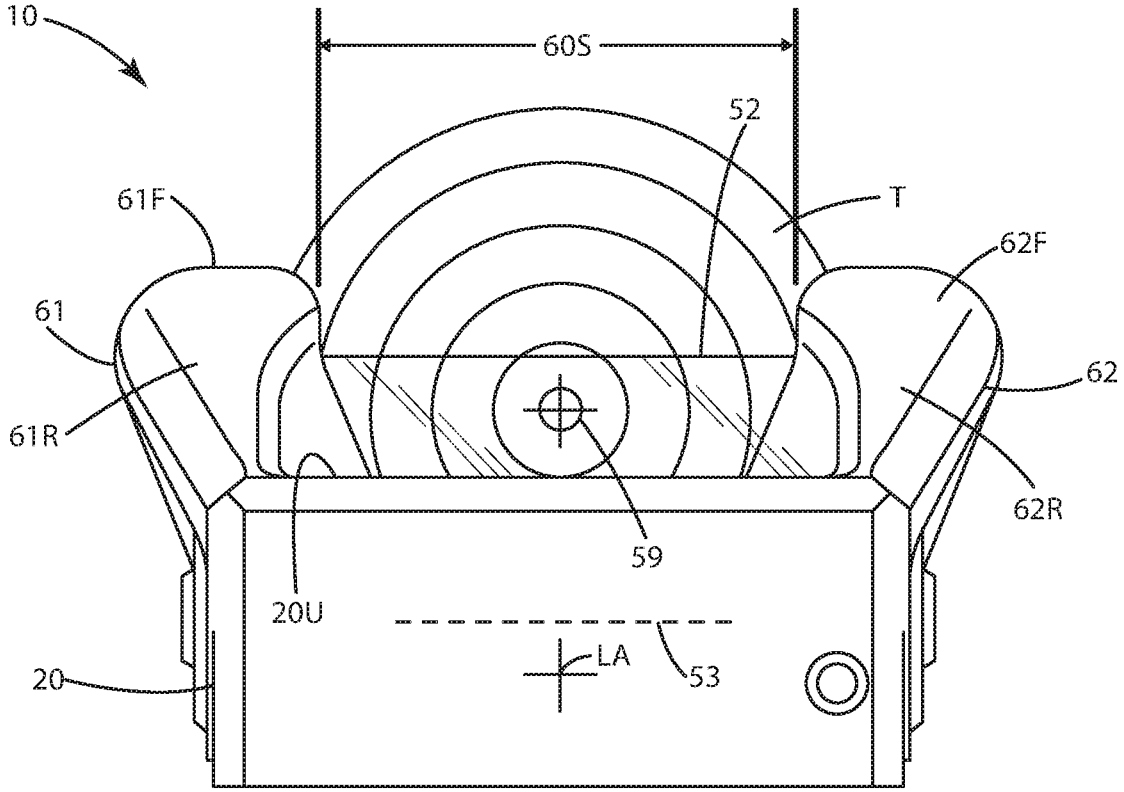
FIG. 6 is a rear view of the aiming device from a user's point of view while acquiring a target.

Generally, the base transitions to the first and second upright arms on opposite sides of the longitudinal axis LA. These arms are disposed across the longitudinal axis from one another, facing toward one another. Each of the first upright arm and second upright arm can include a connector end 61C and 62C. These connector ends 61C and 62C transition to and/or are connected to, or otherwise adjacent, or joined with the base 53. The base 53 can provide support to these arms, adding to the structural integrity of the protective frame 60 around the optical element 50. The first upright arm can extend upward away from the base 63 and terminate at a first free and 61F. The second upright arm can extend upward away from the base 63 and terminate at a second free and 62F. These opposing free ends are disposed on opposite sides of the longitudinal axis LA. These first and second free ends 61F and 62F can be disposed above the base 63 and likewise above the upper surface 20U of the body 20 as shown in FIG. 6.

Each of the first arm 61 and second arm 62 can be further joined with the body 20. For example, first and second ramps 61R and 62R can transition upward from the body upper surface 20U to the respective first and second free ends 61F and 62F of the respective arms. These ramps can provide further structural integrity and rigidity to the upright arms extending above the upper surface 20U of the body 20.

The protective frame 60, with the upright arms terminating at respective free ends 61F and 62F that are disposed laterally on opposing sides of the longitudinal axis LA, therefore does not include any structural component of that frame connecting the first and second upright arms. This in turn forms a top opening span 60S above the optical element viewing recess 69. This top opening span 60S can be in the form of a void defined between the inner surfaces 611 and 621 (FIG. 5) of the respective first and second arms. Optionally, no component or portion of the frame or the arms extends within this top opening span 60S. In this manner, the upper edge 52 of the optical element is exposed through this top opening span 60S of the protective frame 60. With the top span opening, the upper edge 52 of the optical element 50 is exposed to the environment and generally unconcealed by any part of the protective frame extending over or otherwise covering the upper edge. While the upper surfaces 61U and 602U of the first and second arms are vertically higher than that upper edge 52, those upper surfaces of the arms and the arms in general do not extend over and are not is disposed vertically immediately above or directly above the upper edge 52 of the optical element 50. Optionally, due to the exposed nature of the upper edge, a user can touch that upper edge directly with a digit, between the arms.

Figure 5:
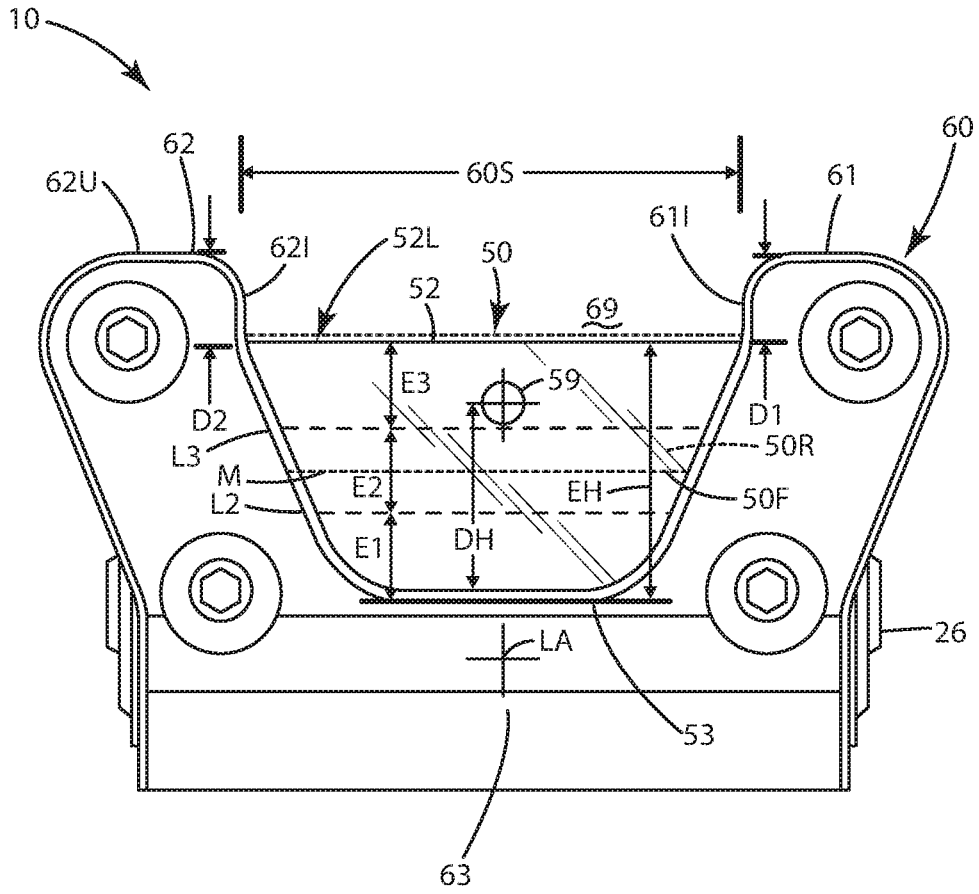
FIG. 5 is a front view of the aiming device.

The protective frame 60 can be configured so it does not prevent direct impact to or direct contact with that upper edge by objects and surfaces external to the sight. However, as shown in FIG. 5, with the first and second upright arms being disposed to the left into the right of the upper edge 52 of the optical element 50, and extending respective distances D1 and D2 above the upper edge 52, those first and second arms can indirectly prevent contact of objects and surfaces with the upper edge 52. For example, because the upper edge 52 is recessed the distances D1 and D2 below the upper surfaces 61U and 62U of the upright arms, the portions of the arms above the upper edge 52 will usually contact an object or surface before the upper edge 52, and in many cases can prevent that upper edge 52 from ever contacting the same. The distances D1 and D2 can be optionally equal, further optionally at least 1 mm, further optionally at least 2 mm, yet further optionally at least 3 mm, even further optionally between 1 mm and 5 mm, inclusive, and even further optionally between 2 mm and 4 mm, inclusive. Further optionally, the optical element upper edge can be supported and covered on its lateral edges and/or lower edge, but unconcealed at its upper edge. This upper edge can be free standing and free from attachment to other parts of the protective frame.

As further shown in FIG. 5, one or more layers of material 52L can be disposed directly on and directly, vertically over the upper edge 52 of the optical element 52 to engage and protect it or provide some other functionality to the optical element or sight. For example, the upper edge 52 can be joined with a layer of material 52L, which is separate from the protective frame 60. This layer of material 52L can be coated, brushed, painted, adhered, welded, melted, sprayed or otherwise deposited on the upper edge 52 of the optical element 50. In one example, the material 52L can be a thin layer of opaque material that is coated on the upper edge 52, without bleeding over onto the front 50F or rear 50R surfaces of the optical element 50. Of course in some cases, where the upper edge 52 transitions at a non-rounded or angled or sharp corner to those surfaces, the layer 52L can extend over that sharp corner to prevent chipping along it. Where the layer of material 52L is opaque, it can impair ambient light from being transmitted into the optical element 50 through the upper edge 52. In some other constructions, the layer material can be translucent and or otherwise light transmissive to some degree. For, example where the optical element and sight will be used in low light conditions, the layer 52L can be more translucent or otherwise light transmissive to ensure the optical element is visible in those low light conditions.

The layer 52L can be constructed from a variety of materials, such as light transmissive and/or light transmission impairing coatings, paints, gels or the like. In other cases, the material of the layer can be a rubber, polymeric, metal, composite, glass, crystal or other thin layer disposed over and contacting the upper edge 52. When constructed from such materials, this layer 52L can be extremely thin, on the order of optionally less than 500 μm, further optionally less than 250 μm, yet further optionally less than 100 μm in thickness. With a thin dimension, the layer will not impair viewing of a target above the upper edge 52 of the optical element 50, and in many cases will not even be perceived by the user of the sight 10.

As shown in FIGS. 3-4, the protective frame 60 can define a support recess 67. The support recess can be defined at least partially by the base 63 and the first and second arms 61, 62. The base can include shoulder 63S that bounds a bottom of the recess 67. The first arm can include a first shoulder 61S that transitions to the base shoulder 63S. The second arm can include a second shoulder 62S that also transitions to base shoulder 63S. The shoulders all can transition to a recess sidewall 68. This recess sidewall 68 can extend through the first arm 61, the base 63 and the second arm 62. This sidewall 68 can conform to the contours and profile of the first sidewall 54 and second sidewall 53 of the optical element 50. The shoulders 61S, 62S 63S can be configured to extend over or generally overlap a rear surface 50R of the optical element 50. The rear surface 50R, also referred to as a rear optical element surface, is disposed in the recess 67. The rear surface 50R also faces toward the shoulders mentioned above and generally toward the user when the sight 10 is in use.

With reference to FIG. 5, the protective frame 60 can include registration features that register and precisely align the optical element 50 relative to the illumination device. For example, the frame can include first and second registration posts 60P1 and 60P2. These posts can be disposed and/or project into the recess 67. The posts can be disposed on the respective shoulders 61S and 62S of the first and second upright arms 61, 62. The posts can be cylindrical, tapered, or some other geometric shape. That geometric shape can match the corresponding geometric shape of a corresponding aperture, for example apertures 50P1 and 50P2 defined by the rear surface 50R of the optical element 50 as shown in FIG. 4. These apertures 50P1 and 50P2 can be predrilled, formed or otherwise incorporated into the optical element 50. Again these registration posts and apertures can align the optical element 50 perfectly within the recess 67 and generally within the viewing opening 69, with the illumination device 30. This in turn precisely locates the optical element when the optical element is replaced after having been removed for service, or when the optical element is swapped out for a different, new or other optical element, depending on the application.

Figure 7:
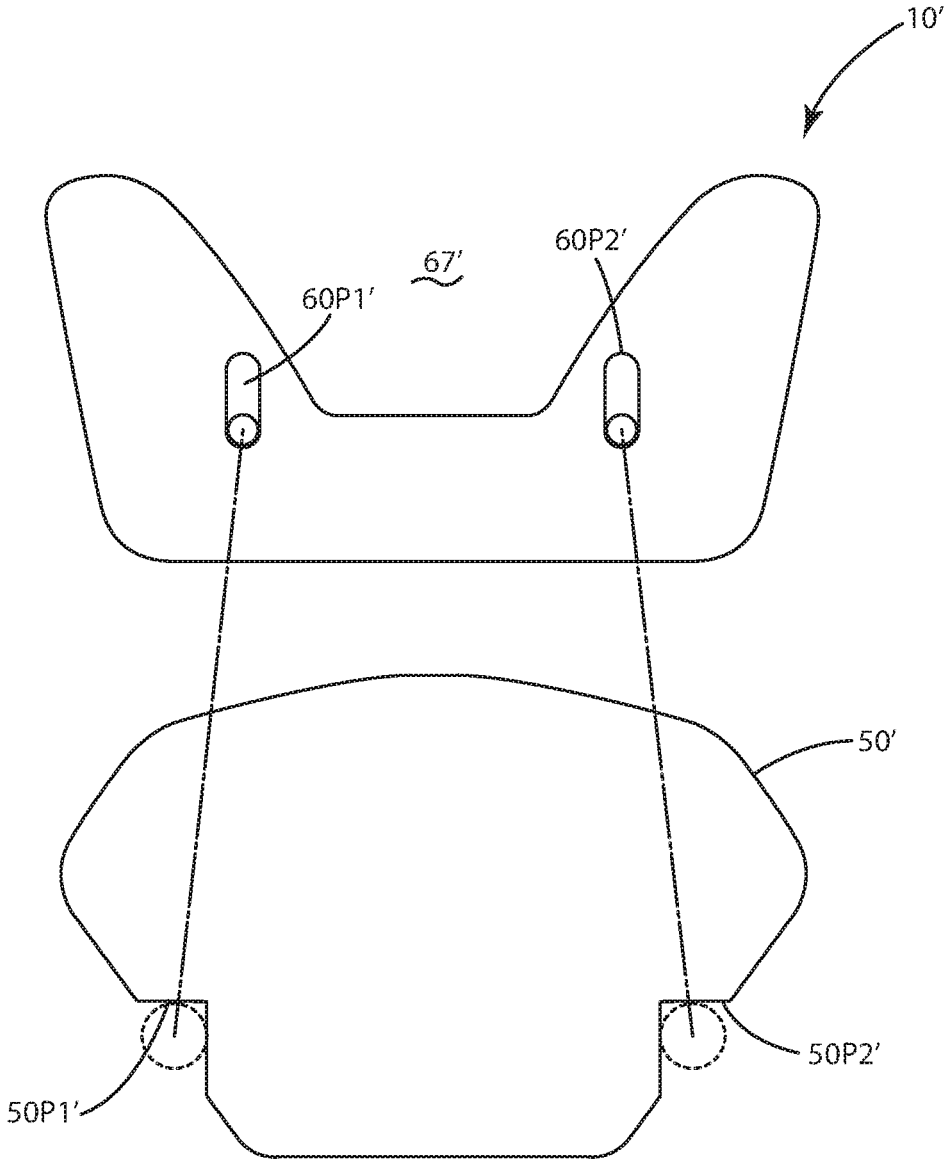
FIG. 7 is an alternative registration feature to align the optical element on the sight.

Other configurations of posts are also contemplated to precisely register and align the optical element 50 with the frame and other components. For example, as shown in FIG. 7, the frame or sight 10' can include posts 60P1' and 60P2'. These posts can be disposed and/or project into the recess 67'. The posts can be cylindrical, tapered, or some other geometric shape. That geometric shape can match or otherwise fit into a corresponding geometric shape of a corresponding recess 50P1' and 50P2' defined by one or more edges of the optical element 50'. These recesses 50P1' and 50P2' can be ground formed or otherwise incorporated into the optical element 50'. Again these registration posts and recesses can align the optical element 50' perfectly within the viewing opening 67', with an illumination device.

Figure 2:
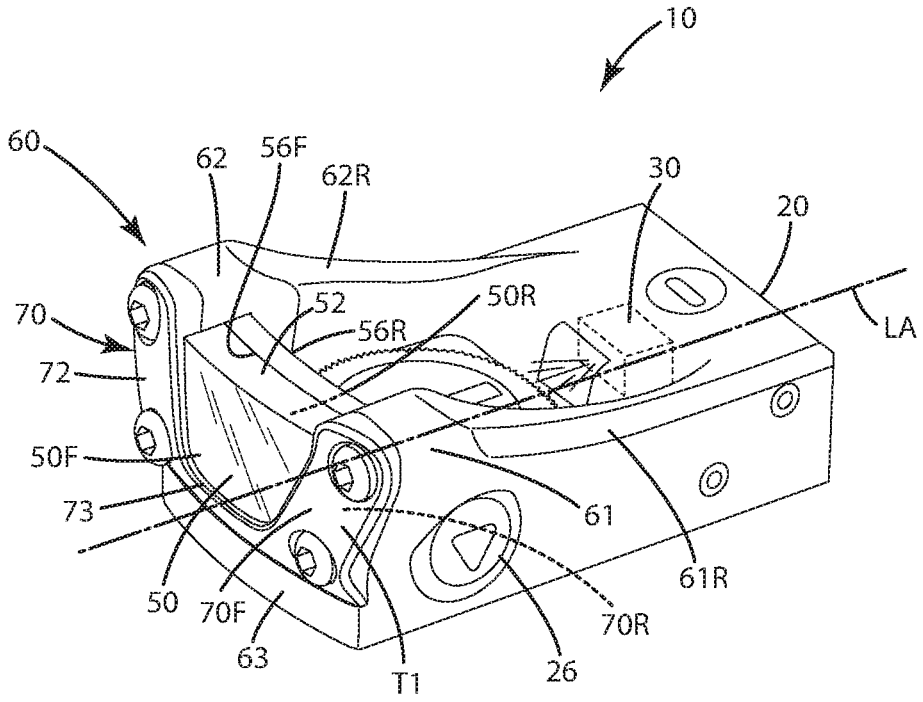
FIG. 2 is a front perspective view of the aiming device.

As shown in FIGS. 2-4, the sight 10 can include a retainer plate 70 associated with the protective frame 60. This retainer plate can be configured to anchor and secure the optical element 50 within the recess 67. This retainer plate can include a base 73, a first upright arm 71 and a second upright arm 72. These components can correspond to the respective base 63, and upright arms 61, 62 of the protective frame 60. The retainer plate can include the front retainer plate surface 70F and a rear retainer plate surface 70R. The front surface 70F can be aesthetically pleasing and can match or otherwise transition well into the remainder of the protective frame 60. The upright arms can also likewise extend upward, above the upper edge 52 of the optical element 50. As with the protective frame, however, optionally no part of the retainer plate 70 extends above, covers or otherwise conceals the upper edge 52 of the optical element.

Optionally, the retainer plate, shown in FIG. 4 can define another second optical element recess 77. This optical element recess 77 can be bounded by a recess wall 78. This recess wall can follow the contours of the respective first side edge 54, lower edge 51 and second side edge 53 of the optical element 50. The recess wall 78 can transition to respective first shoulder 71S, base shoulder 73S and second shoulder 72S of the respective arms and base of the retainer plate. These shoulders can extend at least partially over the front surface 50F of the optical element 50. The front optical element surface can face toward the retainer plate, toward these shoulders and/or toward the rear surface 70R of the retainer plate.

The retainer plate 70 also can define a retainer plate viewing opening 79. This viewing opening 79 can correspond in size and dimension to the viewing opening 69 of the protective frame. The retainer plate 70 can include one or more apertures 70A defined in upright arms and/or the base. These apertures can align with apertures 60A in the protective frame 60. One or more of these apertures can be threaded. Fasteners 70S, which can be in the form of screws, bolts, rivets, studs or other fasteners can be inserted through the apertures 70A and 60A to fasten the retainer plate and thus the optical element 50 removably to the protective frame 60. Optionally, the fasteners 70S can include fastener axes FA that are substantially parallel to the longitudinal axis LA of the sight. Again, the fasteners and the respective apertures can include threads to threateningly secure the fasteners in the respective apertures. When installed, the fasteners can include portions that extend forward of the front surface 50F of the optical element 50.

The fasteners 70S can be removable with a tool by user. In some cases, a tool may not be required, for example, where the retainer plate is attached via a camming mechanism, a latch or some other mechanical structure that is manually securable. In some constructions, the retainer plate can be absent, and the fasteners 70S can be configured to directly engage portions of the optical element 50, for example the front surface, with a head of a screw, to secure that optical element to the protective frame. Other constructions for securing the optical element are also contemplated to make the optical element removable from the sight and/or replaceable.

In some cases, the sight 10 can include cushion elements disposed between the optical element and other components, such as the retainer plate 70 and the protective frame 60. As an example, foam, polymeric, fabric or other types of cushion elements 81 and 82 can be disposed adjacent the front surface 50F and rear surface 50R of the optical element 50. These cushion elements can prevent abrasion and/or compression against the surfaces of the optical element 50, thereby enhancing its longevity and preventing damage. As shown, each of the cushion elements 81 and 82 can include upright arms and a base that correspond to the same features on the protective frame and/or the retainer element. Of course, the cushion elements can be modified to cover only certain portions of the front or rear surfaces, the sidewalls or other portions of the optical element 50, depending on the application and the points of contact between the optical element, the protective frame and any included retainer plate.

Again the retainer plate 70 can be removed from the remainder of the protective frame 60 and the sight 10 in general so that the optical element 50 can be accessed for service, replacement, repair or swapping out with alternate optical elements. As an example of the latter, the sight 10 can be sold in kit form including multiple optical elements. For example, the sight 10 can be sold with different optical elements 50, 50' and 50" as shown in FIG. 4. The precise number of different optical elements in a kit can vary and can be more or less, depending on the application. In some cases, the other optical elements can be identical to the optical element 50. In other cases, the alternate optical elements 50' and 50" can be designed for use in different light conditions. For example, the first optical element 50 can include a first optical coating designed for viewing a displayed dot on the optical element in low light conditions (such as dusk or dawn light). The second optical element 50' can include a second optical coating designed for viewing a displayed dot on the optical element in intense, bright light conditions (such as noon light). The third optical element 50" can include a third optical coating designed for viewing a displayed dot on the optical element in some other light between the foregoing. As other examples, the different optical elements can be of different colors. For example the first one 50 can be clear, the second one 50' can be yellow, and the third one 50" can be green. The different elements can be easily swapped out by user depending on the preference. Indeed, the optical element 50 can be selected and fine-tuned to the dot 59 that is displayed thereon by the illumination device to provide suitable amount of contrast between the dot and the optical element 50.

As shown in FIGS. 3, 5 and 6, the optical element 50 is disposed in the viewing opening 69, generally between the first upright arm 61 and the second upright arm 62. Again, as shown in this embodiment, no part of the protective frame, the body, or the sight extends over the upper edge 52 of the optical element 50. The faces of the optical element include the front surface 50F and the rear surface 50R. The rear surface 50 is faced toward a user when using the sight, while the front surface 50F faces away from the user using the sight. The optical element can be constructed from glass, polymer, polycarbonate, crystal, or other light transmissive or transparent materials. Some non-limiting examples of lenses can include TRIVEX lenses, commercially available from PPG Industries of Pittsburgh, Pa., as well as a nano-layered gradient refractive index (GRIN) lenses, commercially available from Peak Nano of Coppell, Tex. Optionally, lens material can be doped with or otherwise include thermal chromic, photochromic or other light adaptive materials. In this manner, the optical element can function like photochromic lenses, thermochromic lenses or other light adaptive lenses. When including a photochromic material or compound, the optical element, when activated by ultraviolet rays from the sun, can darken. When ultraviolet rays are not present, the optical element can be less darkened or more clear.

The optical element 50 as illustrated can include forward 56F and rearward 56R parts having different radii and optional reflective coatings on a shallower rear surface. Optionally, the optical element 50 can be in the form of a Mangin mirror, having a negative meniscus lens with the reflective surface on the rear side of the glass forming a curved mirror that reflects light without spherical aberration. Of course, other types of optical elements, suitable for reflex type sights to assist in displaying, superimposing or otherwise imaging light or a holographic image on the optical element or in the sight can be utilized.

As mentioned above, the optical element 50 can include multiple edges. For example, optical element 50 can include an upper edge 52, side edges 54 and 53 and a lower edge 51. The upper edge 52 as mentioned above is not concealed by any part of the protective frame or the sight directly above that upper edge, so that upper edge is exposed to the environment and unconcealed by any part of the protective frame directly above the upper edge. The optical element lower edge 51 can be disposed adjacent the base 63. The first edge 54 can be disposed adjacent the first of upright arm 61. The second edge 53 can be disposed adjacent the second upright arm 62.

Where the optical element is installed in the protective frame 60, the upper edge 52 can be configured so that it transitions to the first side edge 54 at a first transition edge 52T1. The upper edge 52 also can transition to the second side edge 53 at a second transition edge 52T2. These transition edges can be gradual or angled and can include a radius or curvilinear and/or linear segments making the transition. In some cases, the first transition edge and the second transition edge are least partially covered by a portion of the respective first upright arm 61 and the second upright arm 62. Generally however remainder of the upper edge is uncovered directly by these arms or the protective frame.

With reference to FIGS. 4-6, the optical element 50 and its relation relative to the dot 59 will be described in more detail. The optical element 50 can include an element height EH extending between the upper edge 52 and the lower edge 53. This element height EH can correspond to the distance between the uppermost portion of the optical element and the lowermost portion of the optical element, which is shown correspond to the upper edge and the lower edge, respectively, or the lowermost portion of the optical element that is visible to a user (the actual lowermost portion of the element might be concealed by or adjacent a portion of the housing). This element height EH can be divided into thirds, that is a lower one third segment E1, a middle third segment E2 and a third upper one third segment E3. The dot 59 optionally can be disposed in the upper third E3 segment of the element height EH. When determined where the dot 59 is located, the center of the dot, which is used as the aiming point and placed on a target to ensure a proper hit on the target, is utilized as the measuring point to determine where precisely the dot is located. For example, if the aiming point or center of the dot 59 is located in the upper third E3 of the element height EH, the dot is considered to be disposed or displayed in that upper one third of the element height EH. This is true, even if a portion of the dot, for example a reticle line, a secondary circle or other element of the dot extends below the level L3 shown in broken lines in FIG. 5. If the center or any point of the dot 59 is located below the line L3, but another portion of the dot, for example a vertical line or a milliradian dot part of the dot extends above the level L3 that dot 59 is considered to be in the middle one third E2 or lower two thirds of the element height EH.

The dot 59 can be disposed at a particular dot height DH. This dot height DH is the distance between the lower edge 53 of the optical element and the center of the dot, which again also can form the aiming point of the dot. The dot height and the element height can have certain relationships relative to one another in the current embodiments. These relationships enable the dot 59 to be displayed much higher on the optical element than in other constructions, which in turn provides a surprising and unexpected increased viewing of a target through the sight 10. In some cases, the dot can be displayed on the optical element, closer to the upper edge than to the lower edge. In other cases, the ratio of the dot height DH to the element height EH can be optionally at least 2:3, further optionally between 2:1 and 1:1, inclusive, yet further optionally between 2:3 and 1:1, inclusive, still further optionally between 3:4 and 2:3. In other cases, the dot 59 can be displayed on the optical element above the middle of the optical element, which is halfway between the upper edge in the lower edge, or disposed half the distance of the element height DH from the lower edge and from the upper edge. In other cases, the dot can be displayed so that its center is immediately below the upper edge 52 and the upper part of the dot is displayed directly on the upper edge, above the center of the dot. Other words, the dot can be can appear to be touching the upper edge. Again, this provides an unexpectedly enhanced view of a target. And because there is no protective frame element of the upper edge 52, the user can see all the target above the dot.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An aiming device comprising:

a body;

an illumination device housed in the body;

a power source in electrical communication with the illumination device;

a protective frame joined with the body, the protective frame including a base, a first upright arm extending upward from the base on a first side of the base, the first upright arm terminating at a first free end above the base, and a second upright arm extending upward from the base on an opposing, second side of the base, the second upright arm terminating at a second free end above the base; and an optical element joined with the protective frame between the first and second upright arms, the optical element extending upward from the base, the optical element including an upper edge that is free from direct attachment to the protective frame, the upper edge spanning between the first and second upright arms, the optical element visible between the first and second upright arms, and above the base, wherein the illumination device is operable to selectively display a dot on the optical element that is visible to a user within a field of view of the user, wherein the upper edge of the optical element transitions to a left side edge and to a right side edges at respective curvilinear transition edges.

2. The aiming device of claim 1, wherein the optical element incudes a lower edge adjacent the base, the left side edge adjacent the first upright arm, the right side edge adjacent the second upright arm, wherein the upper edge transitions to the left side edge at a first curvilinear transition edge, wherein the upper edge transitions to the right side edge at a second curvilinear transition edge, wherein the first curvilinear transition edge and the second curvilinear transition edge are at least partially covered by the respective first upright arm and the second upright arm.

3. The aiming device of claim 1, wherein the upper edge is exposed to an environment, and unconcealed by any part of the protective frame above the upper edge.

4. The aiming device of claim 1, wherein the upper edge is joined with a layer of material, separate from the protective frame, disposed over the upper edge.

5. The aiming device of claim 4, wherein the layer of material is opaque to impair ambient light from being transmitted into the optical element through the upper edge.

6. The aiming device of claim 1, wherein a coating is disposed on the upper edge, wherein the optical element includes a front surface and a rear surface, wherein the coating is not disposed on the front surface and the rear surface.

7. The aiming device of claim 1, wherein the upper edge is disposed a first distance below the first free end of the upright arm, wherein the upper edge is disposed a second distance below the second free end of the upright arm, wherein each of the first distance and second distance is at least 1 mm.

8. An aiming device comprising:

a body;

an illumination device housed in the body;

a power source in electrical communication with the illumination device;

a protective frame joined with the body, the protective frame including a base, a first upright arm extending upward from the base on a first side of the base, the first upright arm terminating at a first free end above the base, and a second upright arm extending upward from the base on an opposing, second side of the base, the second upright arm terminating at a second free end above the base;

an optical element joined with the protective frame between the first and second upright arms, the optical element extending upward from the base, the optical element including an upper edge that is free from direct attachment to the protective frame, the upper edge spanning between the first and second upright arms, the optical element visible between the first and second upright arms, and above the base; and a retainer plate including a front retainer plate surface and a rear retainer plate surface, wherein the protective frame defines a recess, wherein the optical element includes a front optical element surface and a rear optical element surface, wherein the rear optical element surface faces and is disposed in the recess, wherein the front optical element surface faces toward the retainer plate, wherein the retainer plate is disposed adjacent a portion of the optical element to secure the optical element in the recess, wherein the optical element is removable relative to the protective frame, wherein the illumination device is operable to selectively display a dot on the optical element that is visible to a user within a field of view of the user.

9. The aiming device of claim 8, comprising:

at least one fastener extending through the retainer plate and joined with the protective frame so as to removably secure the retainer plate to the protective frame, whereby a user can remove the at least one fastener to access the optical element and remove the optical element.

10. An aiming device comprising:

a body;

an illumination device associated with the body;

a protective frame joined with the body;

an optical element joined with the protective frame, the optical element including an upper edge that is unconcealed by the protective frame above the upper edge, wherein the illumination device is operable to selectively display a dot on the optical element that is visible to a user within a field of view of the user, wherein the optical element includes an element height extending between the upper edge and a lower edge, wherein the dot is displayed on the optical element at a dot height, which is the distance between the lower edge of the optical element and a center of the dot, wherein the ratio of the dot height to the element height is between 2:3 and 1:1, inclusive, wherein the center of the dot remains in a fixed location within the field of view on the optical element.

11. The aiming device of claim 10, comprising:

a first upright arm extending upward from a base on a first side of the protective frame, the first upright arm terminating at a first free end above the base, and a second upright arm extending upward from the base on an opposing, second side of the protective frame, the second upright arm terminating at a second free end above the base, wherein the protective frame thereby includes a top opening span between the first and second upright arms, wherein the upper edge is exposed in the top opening span of the protective frame, whereby a user can directly touch the upper edge of the optical element in the top opening span.

12. The aiming device of claim 10, wherein the optical element includes the lower edge below and distal from the upper edge, wherein the dot is displayed on the optical element closer to the upper edge than to the lower edge.

13. The aiming device of claim 12, wherein the optical element includes an element height extending between the upper edge and the lower edge, wherein the dot is displayed on the optical element in an upper one third of the element height.

14. The aiming device of claim 10, wherein the optical element is transparent such that at user can view a target through the optical element while the dot is displayed on the optical element, wherein the optical element is removably joined with the protective frame, whereby the optical element can be at least one of serviced and replaced when the optical element is removed from the protective frame.

15. An aiming device comprising:

a body;

an illumination device associated with the body;

a protective frame joined with the body; and an optical element joined with the protective frame, the optical element including an upper edge that is unconcealed by the protective frame above the upper edge, wherein the illumination device is operable to selectively display a dot on the optical element that is visible to a user within a field of view of the user, wherein the optical element is a Mangin mirror, wherein the upper edge is covered with a layer of material separate from the protective frame, wherein the dot is at least one of a circular shaped dot, a pattern, a reticle and a sight indicia.

16. The aiming device of claim 15, comprising:

a first upright arm extending upward from a base on a first side of the protective frame, the first upright arm terminating at a first free end above the base, and a second upright arm extending upward from the base on an opposing, second side of the protective frame, the second upright arm terminating at a second free end above the base, wherein the upper edge is at least 1 mm below the first and second free ends.

17. An aiming device comprising:

a body;

an illumination device associated with the body;

a protective frame joined with the body; and an optical element joined with the protective frame, the optical element including an upper edge that is unconcealed by the protective frame above the upper edge, wherein the illumination device is operable to selectively display a dot on the optical element that is visible to a user within a field of view of the user, wherein the optical element includes at least one of a registration post and a registration aperture, wherein the protective frame includes a different one of the at least one of a registration post and the registration aperture, wherein the at least one of the registration post and the registration aperture aligns the optical element with the illumination device to precisely locate the dot on the optical element when the optical element is replaced after having been removed.

18. An aiming device comprising:

a body;

an illumination device associated with the body;

an optical element joined with the body, the optical element including an upper edge and a lower edge, wherein the illumination device is operable to selectively display a dot on the optical element closer to the upper edge than to the lower edge, the dot being visible to a user within a field of view of the user, wherein the dot is reflected from a curved portion of the optical element toward the user, wherein the dot remains in a fixed location within the field of view on the optical element when the aiming device is aimed by the user in a plurality of directions.

19. The aiming device of claim 18, wherein the optical element includes an element height extending between the upper edge and the lower edge, wherein the dot is displayed on the optical element at a dot height, which is the distance between the lower edge of the optical element and a center of the dot, wherein the ratio of the dot height to the element height is between 2:3 and 1:1, inclusive, wherein the upper edge transitions to a side edge at a curvilinear edge having a radius.

* * * * *